US005198621A

United States Patent [19]

Kojima

[11] Patent Number: 5,198,621

[45] Date of Patent: Mar. 30, 1993

[54] TWISTED CABLE

[75] Inventor: Toru Kojima, Funabashi, Japan

[73] Assignee: The Furukawa Electric Co., Ltd., Tokyo, Japan

[21] Appl. No.: 816,745

[22] Filed: Jan. 2, 1992

[51] Int. Cl.[5] ..... H01B 5/10

[52] U.S. Cl. ..... 174/128.1; 174/128.2; 174/131 A

[58] Field of Search ..... 174/128.1, 128.2, 126.1, 174/130, 131 R, 131A, 131 B; 57/223, 222, 221, 220, 217, 216

[56] References Cited

U.S. PATENT DOCUMENTS 3,468,119 9/1969 Kuratomi ..... 174/128.1
3,813,481 5/1974 Adams ..... 174/130
4,156,104 5/1979 Mondello ..... 174/131 R X
4,777,324 10/1988 Lee ..... 174/128.1 X

FOREIGN PATENT DOCUMENTS 40922 9/1981 Japan .

*Primary Examiner*—Morris H. Nimmo
*Attorney, Agent, or Firm*—Pearne, Gordon, McCoy & Granger

[57] ABSTRACT

A twisted cable comprising a core including at least one hard steel wire, carbon fibers and resin and conducting metal wires twisted around the core, the hard steel wire having a ratio of cross section of 10 through 40% based on a total of cross sections of the hard steel wire and the carbon fibers.

6 Claims, 3 Drawing Sheets

TWISTED CABLE

BACKGROUND OF THE INVENTION

A twisted cable used as a conductor for aerial transmission line is required to have certain lightness and low thermal expansion coefficient because small slack is preferable in practice.

In general, such a twisted cable comprises a core having high physical strength and conducting metal wires such as aluminum wires twisted around the core.

In one of the prior arts, the core of the twisted cable is formed of invar wires having thermal expansion coefficient of $2.5\times10^{-6}$ through $4\times10^{-6}$/°C. lower than those of steel wires. In another prior art, the core of the twisted cable is formed of material including relatively light carbon fibers as disclosed in Japanese Patent Application Publication No. 40922/1981.

Although the Japanese Patent Application Publication No. 40922/1981 never refers to thermal expansion coefficient of carbon fibers which are used as material of the core, it is well known that the thermal expansion coeffcient of carbon fibers is equal to or lower than that of the invar wires. Thus, it is confirmed that the core formed of carbon fibers reinforced by resin has thermal expansion coefficient not higher than $2\times10^{-6}$.

It is supposed that the core including carbon fibers may be manufactured in the following manner.

A plurality of carbon fiber filaments having a diameter of 7 through 10 μm are impregnated with resin and are twisted to form a carbon fiber twisted element. The thus producetd twisted element has a tape of polyester lapped thereon to form element lines.

The element lines may be used as the core of the twisted cable either in a straight manner or in a twisted manner after the impregnated resin is cured.

This is because the core formed of only carbon fibers has relatively low physical strength and is likely to to snap off as soon as undergoing bending stress unless the carbon fibers are cured with resin.

In general, an aerial transmission cable is subject to high temperature during its operation to thereby cause a problem. This problem can be solved by heightening thermal resistance of the resin used. Practically, the core can withstand a temperature of 240° C. at most.

On the other hand, the aerial transmission cable has accidental insulation destruction due to lightning stroke and a subsequent alternate arc generated when reverse flashing runs from the transmission cable to ground. At the moment, a temperature of the core reaches 1000° C. or possibly a few thousands degree C. for a very brief time because of the alternate arc. Thus, aluminum wires which are the conducting metal wires are often melted and the high heat sometimes reaches the core. But, since no resin can withstand a temperature higher than 1000° C., the resin will burn out when the core is subject to such a high temperature.

Such being the case, the prior twisted cable comprising the core of carbon fibers reinforced by resin and the conducting metal wires such as aluminum wires twisted around the core will lose resin which serves to maintain the physical strength of carbon fibers which usually endure the arcing when the twisted cable is subject to the arc. Thus, since there occurs a breakage of the twisted cable, which causes them to be lacking in its reliability.

On the other hand, the cable having a core including invar wires is heavy-weighted and has thermal expansion coefficient higher than that of the core including carbon fibers at high temperature. Therefore, the twisted cable has a large amount of slack in practice.

SUMMARY OF THE INVENTION

Accordingly, it is a principal object of the invention to provide a twisted cable having lightness and low thermal expansion coefficient.

It is another object of the invention to provide a twisted cable having high reliability in enduring arcing without burning out.

In accordance with one aspect of the invention, there is provided a twisted cable comprising a core and conducting metal wires twisted around said core, said twisted cable characterized by said core including at least one hard steel wire, carbon fibers and resin and said hard steel wire having a ratio of cross section of 10 through 40% based on a total of cross section of said hard steel wire and said carbon fibers.

In accordance with another aspect of the invention, there is provided a twisted cable comprising a core and conducting metal wires twisted on said core, said twisted cable characterized by said core comprising resin reinforced carbon fibers including at least one hard steel wire and said hard steel wire having a ratio of cross section of 10 through 40% based on a total of cross sections of said hard steel wire and said carbon fibers.

In accordance with further aspect of the invention, there is provided a twisted cable comprising a core and conducting metal wires twisted around said core, said twisted cable characterized by said core comprising a twisted element formed by twisting at least one hard steel wire and at least one resin reinforced carbon fiber and said hard steel wire having a ratio of cross section of 10 through 40% based on a total of cross sections of said hard steel wire and said carbon fibers.

In the case of the core having at least one hard steel wire in addition to carbon fibers, even though the resin to reinforce the carbon fibers would burn out when the twisted cable is subject to an arc, it can still have physical strength to endure tension because of the hard steel wire and therefore it is never broken out.

Furthermore, with the hard steel wire having the ratio of cross section of 10 through 40% based on the total of cross sections of the hard steel wire and the carbon fibers, there is nothing to hurt lightness, which greatly assists in easily handling the twisted cable and there is also provided low thermal expansion coefficient. Thus, the twisted cable can practically have a very small amount of slack.

BRIEF DESCRIPTION OF THE DRAWINGS

The above and other features and objects of the invention will be apparent from the detailed description of the embodiments of the invention taken along with reference to the accompanying drawings in which.

DESCRIPTION OF PREFERRED EMBODIMENTS OF THE INVENTION

Figure 1:
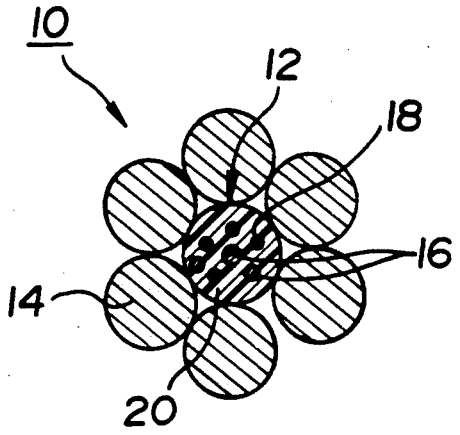
FIG. 1 is a cross sectional view of a twisted cable constructed in accordance with the first embodiment of the invention.

Referring now to the accompanying drawings, FIG. 1 illustrates a twisted cable 10 constructed in accordance with the first embodiment of the invention. The twisted cable 10 comprises a core 12 and conducting metal wires 14 twisted around the core 12.

In the illustrated embodiment of FIG. 1, the core 12 is formed of a composite of a plurality of hard steel wires 16 and a plurality of fine carbon fibers 18 spotted within a resin 20. Thus, it will be noted that the core 12 comprises resin reinforced carbon fibers containing the hard steel wires 16. The hard steel wires 16 essentially have a ratio of cross section of 10 through 40% based on to a total of cross sections of the hard steel wires 16 and the carbon fibers 18 while the carbon fibers 18 have the remaining ratio of cross section that is 90 through 60%.

The hard steel wires 16 may be any of galvanized specially reinforced steel wires, galvanized steel wires for a core of conventional ACSR, aluminum plated steel wires and invar wires, for example, and the resin 20 for combining the hard steel wires 16 and the carbon fibers 18 may be either of thermosetting resin such as epoxy resin (denatured epoxy resin or heat resisting epoxy resin) or of bismaleimide resin and thermoplastic resin such as polycarbonate resin, for example.

The hard steel wires 16 provided in the core 12 in addition to the carbon fibers 18 can bear the tension of the twisted cable 10 even though the resin 20 would burn out when there occurs arc on flashing of the twisted cable 10. The ratio of cross section of the hard steel wires 16 based on the total of cross sections of the hard steel wires 16 and the carbon fibers 18 is set at 10 thourgh 40% for the following reason. The twisted cable 10 having a ratio of cross section of the hard steel wires 16 not more than 10% will break off due to the fact that the tensile strength decreases when the resin burns out or is lost while the twisted cable 10 having a ratio of cross section of the hard steel wires 16 more than 40% will have an adverse effect on and increase a thermal expansion coefficient, which enlarges an amount of slack on the twisted cable 10 strung aerially.

Figure 2:
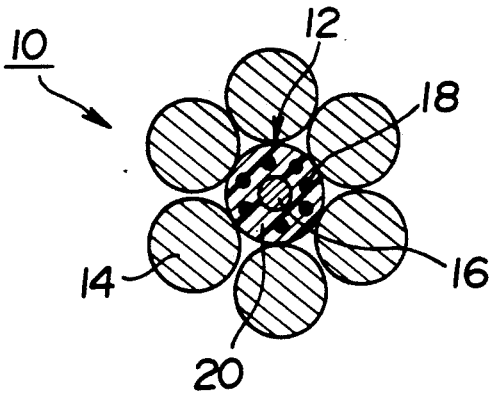
FIG. 2 is a cross sectional view of a twisted cable constructed in accordance with the second embodiment of the invention.

FIG. 2 illustrates the twisted cable 10 constructed in accordance with the second embodiment of the invention. The twisted cable 10 is substantially identical to the twisted cable 10 of FIG. 1 except for the core 12 comprising a carbon fiber reinforced resin 22 containing a single hard steel wire 16 provided at the center thereof. Of course, the ratio of cross section of the hard steel wire 16 is essentially so set as to fall within 10 through 40% of the total of cross sections of hard steel wire 16 and the carbon fibers 18. The resin reinforced carbon fibers 22 are formed by reinforcing the plurality of carbon fibers with the resin 20.

It should be noted that the hard steel wire 16 having the aforementioned ratio of cross section prevents the twisted cable 10 of FIG. 2 from breaking off and allow the twisted cable 10 to have certain lightness and a small amount of slack in being aerially strung.

Figure 3:
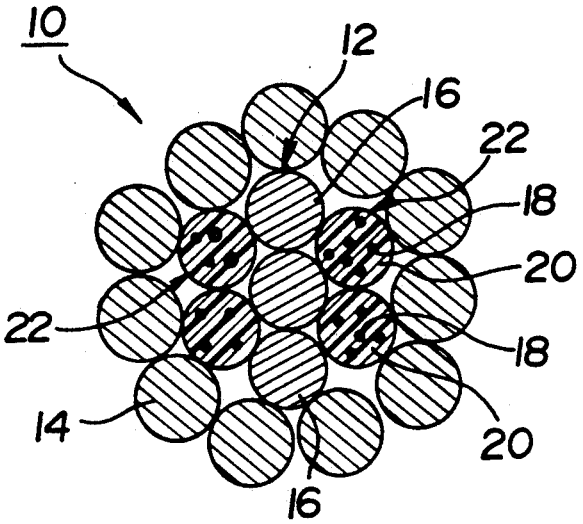
FIG. 3 is a cross sectional view of a twisted cable constructed in accordance with the third embodiment of the invention.

FIG. 3 illustrates the twisted cable 10 constructed in accordance with the third embodiment of the invention. The twisted cable 10 is substantially identical to the twisted cables 10 of FIGS. 1 and 2 except for the core 12 being formed by twisting a plurality of hard steel wires 16 and a plurality of resin reinforced carbon fibers 22. Of course, the ratio of cross section of the hard steel wires 16 is essentially so set as to fall within 10 through 40% of the total of cross sections of the hard steel wires 16 and the carbon fibers 18. The resin reinforced carbon fibers 22 are formed by reinforcing the plurality of carbon fibers 18 with the resin 20.

Figure 4:
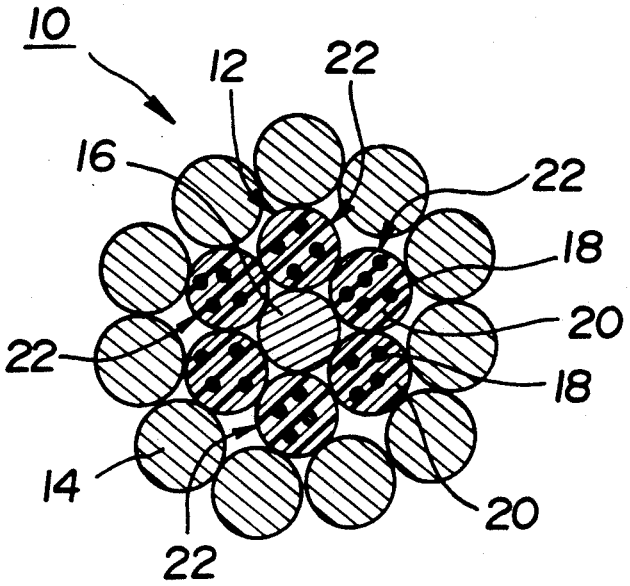
FIG. 4 is a cross sectional view of a twisted cable formed by modifying that of FIG. 3.

The twisted cable 10 of FIG. 4 is substantially identical to that of FIG. 3 except for only one hard steel wire 16 disposed at a center of the core 12.

It should be noted that in the embodiments of FIGS. 3 and 4, the hard steel wire or wires 16 having the aforementioned ratio of cross section can prevent the twisted cables 10 of FIGS. 3 and 4 from breaking off and thus the twisted cables 10 thereof have certain lightness and a small amount of slack when aerially strung, which is identical to those of FIGS. 1 and 2.

Figure 5:
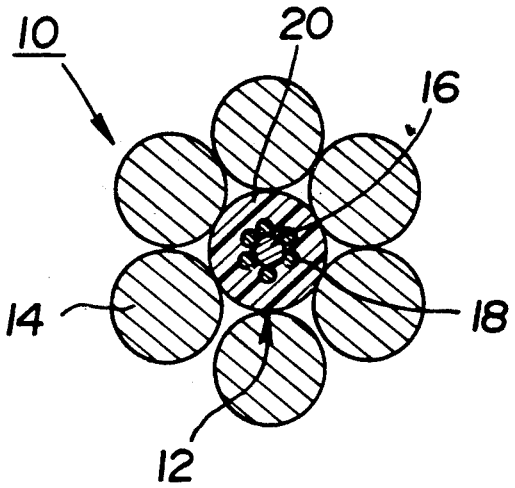
FIG. 5 is a cross sectional view of a twisted cable constructed in accordance with the fourth embodiment of the invention.

FIG. 5 illustrates the twisted cable 10 constructed in accordance with the fourth embodiment of the invention. The twisted cable 10 is substantially identical to the twisted cables 10 of FIGS. 1 through 4 except for the core 12 being formed by twisting a plurality of resin reinforced carbon fibers 22 around the centered fine hard steel wires 16. Of course, the ratio of cross section of the hard steel wires 16 is essentially so set as to fall within 10 through 40% of the total cross section of hard steel wires 16 and the carbon fibers 18. The resin reinfroced carbon fibers 22 are formed by reinforcing the plurality of carbon fibers 18 with the resin 20.

It should be noted that in the embodiment of FIG. 5, the hard steel wires 16 having the aforementioned ratio of cross section can prevent the twisted cable 10 of FIG. 5 from breaking off and provide to the twisted cable 10 certain lightness and a small amount of slack when aerially strung, which is identical to those of FIGS. 1 through 4.

The following table shows the relationship between linear expansion coefficient C ($\times 10^{-6}$/°C.) or specific gravity G and the ratio of cross section HS (%) of the hard steel wires 16 with parametric reference to the ratio of coss section CF (%) of the carbon fibers 18. This table reveals how "C" and "G" shift and their relation for making clear the reason why the ratios of cross section of the hard steel wires 16 and the carbon fibers 18 fall within 10 through 40% and 90 through 60%, respectively.

TABLE

| CF (%) | HS (%) | C | G |
|---|---|---|---|
| 100 | 0 | 2.0 | 1.5 |
| 90 | 10 | 3.36 | 2.13 |
| 80 | 20 | 4.59 | 2.76 |
| 70 | 30 | 5.71 | 3.39 |
| 60 | 40 | 6.75 | 4.02 |
| 50 | 50 | 7.69 | 4.65 |
| 40 | 60 | 8.60 | 5.28 |
| 30 | 70 | 9.36 | 5.91 |
| 20 | 80 | 10.12 | 6.54 |
| 10 | 90 | 10.89 | 7.17 |
| 0 | 100 | 11.5 | 7.8 |

The twisted cables were designed and produced in reference to the above table to determine the relationship between tension and slack. It ought to be noted that the core having the ratio of cross section of the hard steel wires more than 40% has the larger linear expansion coefficient C and the larger specific gravity G, which causes the twisted cable to have the effect of the slack reduction lower than that of the twisted cable having aluminum wires twisted around the core of invar wires. Also, it will be noted that the ratio of cross section of the hard steel wires less than 10% has the physical strength lowering to around 10% of breaking load of an aluminum cable steel reinforced (ACSR) having the cross section of 160 to 410 $mm^2$ which has been conventionally used. Thus, it will be understood that the ratio of cross section of the hard steel wires is required to fall within the range of 10 through 40%.

Figure 6:
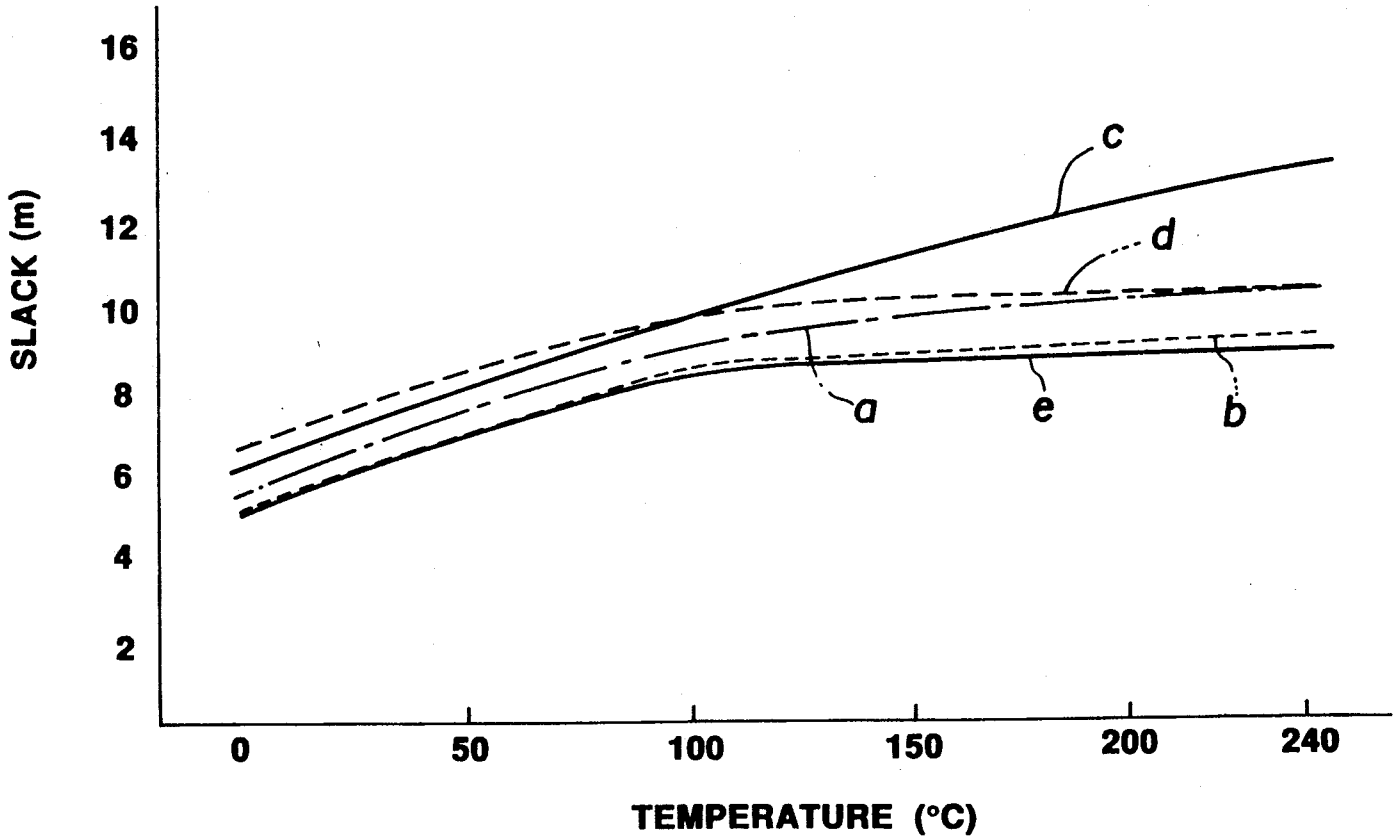
FIG. 6 illustrates comparison of slack characteristics of twisted cables of the invention and the prior arts.

FIG. 6 shows temperature-slack characteristics as a and b for the twisted cable of the present invention and temperature-slack characteristics as c, d and e for the twisted cables of the prior arts, respectively. The characteristic a is that of the cable of the invention comprising the core of hard steel wires having the ratio of cross section of 40% while the characteristic b is that of the cable of the invention comprising the core of hard steel wires having the ratio of cross section of 10%. The cables of the invention were constructed in accordance with the embodiment of FIG. 1. The characteristic c is that of the cable of the prior art comprising the core of aluminum plated steel wires, the characteristic d is that of the cable of the prior art comprising the core of invar wires and the characteristic e is that of the cable of the prior art comprising the core of resin reinforced carbon fibers.

The slack of the aerial line was figured out under assumptive conditions of span length of 300 m, wind pressure of 100 $kg/m^2$ at a high temperature of 15° C. and wind pressure of 50 $kg/m^2$ at a low temperature of −15° C. and with icing of 6 mm thickness and specific gravity of 0.9 atound the cables and also with a maximum available tension of 5,000 kg under such severe conditions.

As noted from FIG. 6, the slack characteristics a and b of the cables of the invention are preferred ones because they are positioned between the looseness characteristic d of the invar core aluminum cable and that e of the carbon fiber reinforced resin core cable. However, the cables comprising the core of hard steel wires having the ratio of cross section more than 40% has the effect of the looseness reduction worse than that of the invar core aluminum cable. Thus, it will be understood that the ratio of cross section of the hard steel wires is required to have the maximum value of 40%.

Although some preferred mebodiments of the invention have been illustrated and described with reference to the accompanying drawings, it will be understood by those skilled in the art that they are for examples, and that various changes and modifications may be made without departing from the spirit and scope of the invention. For example, although, in the embodiment of FIG. 1, the core comprises a single element of resin reinforced carbon fibers having hard steel wires contained, it may be formed by twisting a plurality of elements of resin reinforced carbon fibers. Thus, it should be understood that the invention is intended to be defined only to the appended claims.

What is claimed is:

1. A twisted cable comprising a core and conducting metal wires twisted around said core, said twisted cable characterized by said core including at least one hard steel wire, carbon fibers and resin and said hard steel wire having a ratio of cross section of 10 through 40% based on a total of cross sections of said hard steel wire and said carbon fibers.

2. A twisted cable comprising a core and conducting metal wires twisted around said core, said twisted cable characterized by said core comprising resin reinforced carbon fibers including at least one hard steel wire and said hard steel wire having a ratio of cross section of 10 through 40% based on a total of cross section of said hard steel wire and said carbon fibers.

3. A twisted cable as set forth in claim 2, and wherein a plurality of hard steel wires are disposed in said resin reinforced carbon fibers in a spotted manner.

4. A twisted cable as set forth in claim 2, and wherein a single hard steel wire is disposed in said resin reinforced carbon fibers around a center thereof.

5. A twisted cable as set forth in claim 2, and wherein a plurality of hard steel wires are twisted and disposed in said resin reinforced carbon fibers around a center thereof.

6. A twisted cable comprising a core and conducting metal wires twisted on said core, said twisted cable characterized by said core comprising a twisted element formed by twisting at least one hard steel wire and at least one element of resin reinforced carbon fibers and said hard steel wire having a ratio of cross section of 10 through 40% based on a total of cross sections of said hard steel wire and said carbon fibers.

* * * * *